US005506571A

United States Patent [19]

Dugan

[11] Patent Number: 5,506,571

[45] Date of Patent: Apr. 9, 1996

[54] LOW AIR WARNING DEVICE FOR SCUBA DIVERS

[76] Inventor: Donald L. Dugan, 88 La Cumbre Cir., Santa Barbara, Calif. 93105

[21] Appl. No.: 174,842

[22] Filed: Dec. 29, 1993

Related U.S. Application Data

[63] Continuation-in-part of Ser. No. 941,732, Sep. 8, 1992, abandoned.

[51] Int. Cl.[6] ..... G08B 21/00

[52] U.S. Cl. ..... 340/626; 364/413.31; 128/201.27

[58] Field of Search ..... 340/626; 364/413.31; 128/201.27

[56] References Cited

U.S. PATENT DOCUMENTS

| | | | |
|---|---|---|---|
| 4,563,758 | 1/1986 | Pasternostro | 128/201.27 |
| 4,658,358 | 4/1987 | Leach et al. | 128/201.27 X |
| 4,800,373 | 1/1989 | Mayz | 128/201.27 X |
| 4,882,678 | 11/1989 | Hollis et al. | 128/201.27 |
| 4,949,072 | 8/1990 | Comerford et al. | 128/201.27 X |
| 5,033,818 | 7/1991 | Barr | 330/525 |
| 5,191,317 | 3/1993 | Toth et al. | 340/676 |

*Primary Examiner*—John K. Peng
*Assistant Examiner*—Edward Lefkowitz
*Attorney, Agent, or Firm*—Michael G. Petit

[57] ABSTRACT

A low air warning device for scuba divers. The low air warning device attaches to the first stage of the air regulator, which is attached to the top of the air tank. The low air warning device, being compact and easily used, sounds an audible alarm in the event of low air levels. The low air warning device utilizes a piezo speaker element and driver, located within the waterproof housing, to produce an audible tone which is easily heard under water. The low air warning device automatically turns itself on and off utilizing a water conductivity activation switch.

1 Claim, 2 Drawing Sheets

LOW AIR WARNING DEVICE FOR SCUBA DIVERS

CROSS REFERENCE TO RELATED APPLICATIONS

This is a continuation-in-part of application Ser. No. 07/941,731, filed Sep. 8, 1992, now abandoned.

BACKGROUND—FIELD OF THE INVENTION

1. Field of Invention

This invention relates to a low air warning device for scuba divers, specifically to a new and improved version. Accordingly, the main purpose of this invention is the audible warning given to the scuba diver who depletes his or her air levels beyond the recommended safe levels established by certified diver safety organizations. Scuba divers rely on compressed air to sustain them while under water. The air is monitored by an air gauge, which hangs off the diver's side, but is usually out of direct view. A diver has to make a conscience effort to grab and look at the air gauge. The air gauge gives a continuous visual display of the remaining pressure in the air tank, providing the air gauge is working properly. Running out of air while under water is a life threatening situation. The bends can occur if the diver, no longer having a reserve air supply, has to race to the surface without making a required decompression stop. A diver can develop an air embolism in the event he or she panics after running out of air, and forgets to ventilate properly on the ascent. The solution is a secondary air monitoring device, which gives an audible warning of pending air depletion, but is small, carefree and compact enough to be used by scuba divers.

2. Description of Prior Art

Numerous types of low air warning devices have been developed and are in use today. For example: low air warning devices on big-Rig type trucks utilizing compressed air to operate the braking system, have been required by federal law since September 1959 to be equipped with a visual flagging or audible type low air warning device. Although many low air warning devices are in use today, the majority of these devices are not compatible with scuba diving. Only one application was a low air warning device pertain to scuba diving a U.S. Pat. No. 4,800,373, which was issued to Allen Mayz. discloses, a low air warning device which gives both an audible and visual low air warning. Although the unit provides a low air warning, it is both bulky and redundant. The audible portion of the low air warning device is by the head, where it should be located, but there is a redundant visual low air warning indicated on the diver's air gauge console connected by an external cable. The visual low air warning is not needed since one would have to make a conscience effort to look at the device. In this case the air gauge itself could just as easily be read. The bulkiness of the disclosed device is also a negativity. A diver carries a plethora of dive equipment, from cameras to spear guns. A diver may have up to four separate lines hanging from the valve portion of the air tank and added lines are not wanted. It is also another portion of the diver's gear that can get snarled up in kelp or possibly a fishing net. Another area of concern is the internal speaker of the disclosed device. Because of the negative acoustic effects of a speaker device mounted within the confines of an enclosed chamber, it is unlikely the device would actually be heard under water. And yet another negative aspect of the disclosed device is the manual on-off switch. This would be like putting an on-off switch on your smoke detector at home. If it can manually be turned off it will be turned off. Whether a diver forgets to turn the disclosed device on before the dive or during the dive after the alarm sounds because it becomes distracting, a dangerous situation exists. If the diver, through use, becomes dependant on the device and fails to turn it on prior to the dive, divers using such a device are setting themselves up for disaster. Another example of a low air warning device is found in U.S. Pat. No. 5,035,239. Although this is a low air warning device for breathing apparatus, it is neither intended for use for scuba diving or compatible with existing scuba diving equipment. The disclosed device is intended for contaminated air (i.e. smoke, dust, etc.). While the above stated devices give audible warning for pressurized air supplies, most of which are not suitable for scuba diving. On the one instance where a low air warning device is applicable, it can be appreciated that much needed improvements are necessary.

It is therefore an object of the present invention to provide a new and improved low air warning device for scuba divers which has all the advantages of prior art low pressure warning devices and none of the disadvantages.

It is another object of the present invention to provide a new low air warning device for scuba divers which is more compact, easier to install, easier to construct, and less expensive to produce.

It is yet another object of the present invention to provide a new low air warning device for scuba divers which provides, deletes, and improves on apparatuses and methods of prior art stated with all of the advantages with none of the disadvantages.

It is another object of the present invention to provide a new low air warning device for scuba divers which automatically turns on when immersed in water, and automatically turns off when taken out of water.

Still another object of the present invention to provide a new low air warning device for scuba divers with superior speaker element configuration to enhance and transmit the audible signal from within the unit, through the waterproof casing, and on to the divers ears.

These together with the objects of the invention, along with the various novel features which characterize the invention, are distinguished and pointed out in detail in the claims annexed to this disclosure.

DRAWING FIGURES

DESCRIPTION OF THE PREFERRED EMBODIMENT

Figure 1:
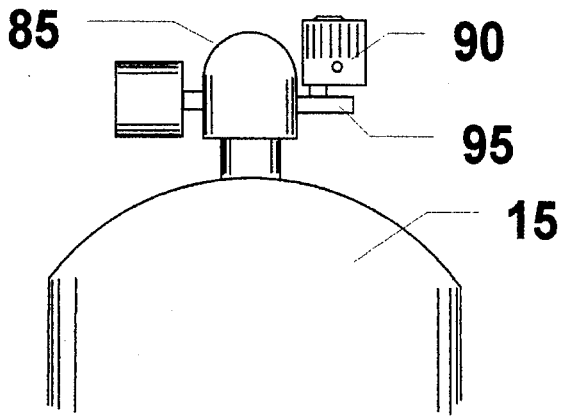
FIG. 1 is a perspective view of the low air warning device for scuba divers of the present invention installed on a scuba diver's air tank.
Figure 2:
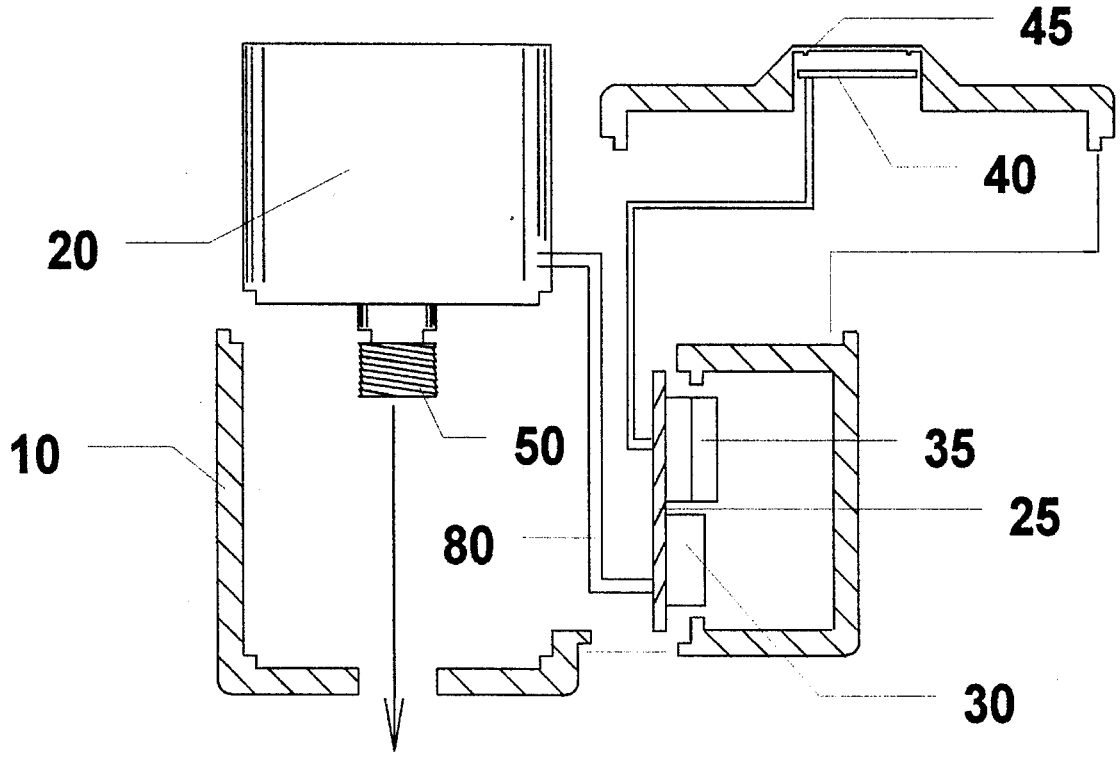
FIG. 2 is a perspective side cut away view of the low air warning device for scuba divers of the present invention.

With reference to the drawings, and in particular to FIG. 1 therefore, a new and improved low air warning device for scuba divers representing the principles and concepts of the present invention and generally designated by the reference numeral 90 will be described. Please note that the first embodiment 1 of the invention is designed to be used in conjunction with a first stage 85 of the air regulator. The first stage has both high pressure and low pressure air ports. The low air warning device 90 is screwed into a spare high pressure air port 16. If a spare high pressure air port is not available, then a "Y" fitting 95 can be used to attach the unit to the first stage of the air regulator. The first stage of the air regulator is mounted to the top of the air tank 15. This situates the low air warning device directly behind the diver's head. With reference now to FIG. 2, that a threaded portion 50 of the pressure switch 20 extends through the waterproof housing 10. This fitting serves as a means to secure the device to the first stage of the air regulator. The pressure switch is a two stage pressure switch. The pressure switch electrical connections are normally closed with no air being introduced into the switch. When sufficient air pressure is introduced into the switch, the electrical connections are opened. The air introduced into the switch may push against an internal piston. The piston may have a tension spring forcing the piston in a closed position. When sufficient air pressure is introduced into the switch, the piston is forced backwards, partially compressing the spring, and opening the electrical circuit. A circuit board 25 is located within the waterproof housing. A battery 35 and central processing unit (CPU) 30 are mounted on the circuit board. The audible tone is produced by a piezo speaker element 40 secured to the interior of the waterproof housing, located at the top of the low air warning device. The piezo speaker element is bonded to a special mount 45 to increase efficiency.

Figure 3:
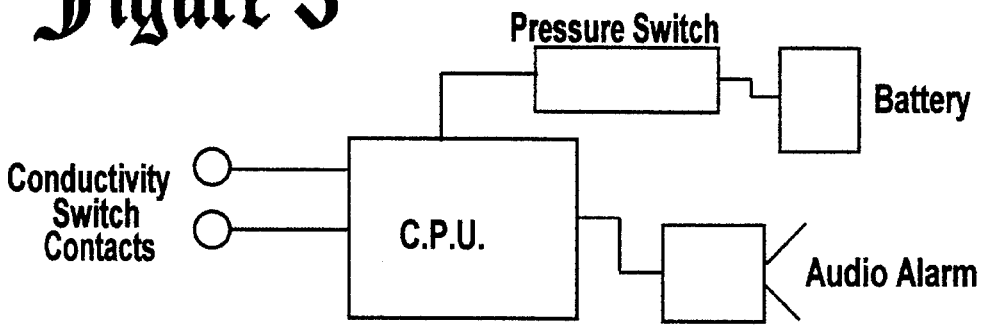
FIG. 3 is a schematic diagram of the low air warning device for scuba divers of the present invention depicting all electrical components and drive circuits.

With reference now to FIG. 3, a schematic diagram detailing the circuitry and drive circuits for the electrical components. The circuit is powered by a battery 35 supplying power to a central processing unit 30. The circuit is enabled by two water conductivity switch contacts (FIG.5) 60 which protrude through the waterproof housing on either side. The CPU uses the natural electric conductivty of water to enble the circuitry. When the water conductivity contacts are connected, electrical power is supplied to the pressure switch 20. When sufficient air pressure is introduced into the air pressure switch, the circuit is broken. When the air pressure falls to a predetermined level, electrical current is supplied to an oscillator circuit, on to the piezo speaker element drive circuit, and a subsequent pulse sounding of the audible alarm. When the water conductivity contacts are unconnected, the alarm will discontinue.

Figure 4:
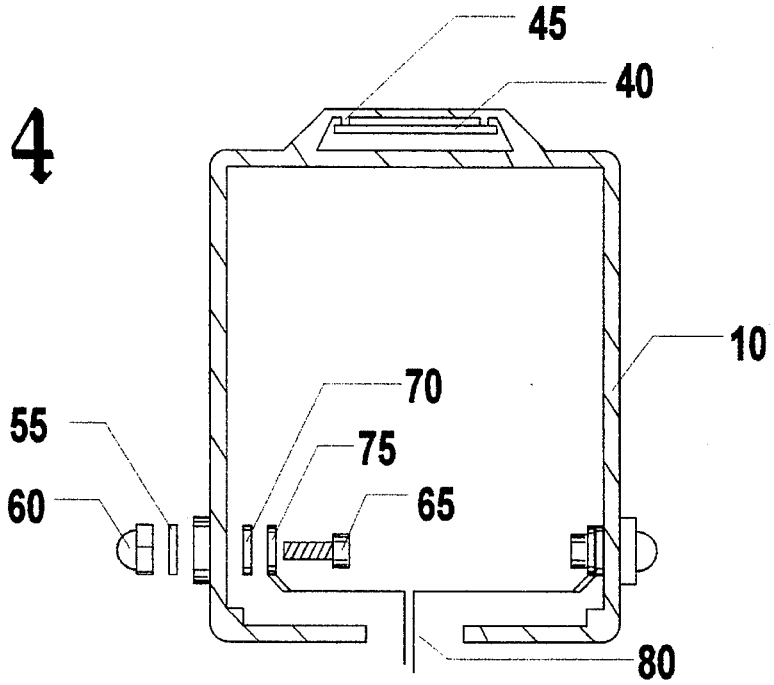
FIG. 4 is a perspective view of the water conductivity on-off switch contacts, both exploded and assembled of the low air warning device for scuba divers of the present invention.

With reference now to FIG. 4, detailed construction of the water conductivity contacts consisting of, a stainless steel hex nut cap 60 fastened to the exterior of the waterproof housing 10. Situated between the exterior of the waterproof houing and the stainless steel hex nut is a rubber "O" ring 55. A stainless steel bolt 65 passes from the interior of the waterproof housing, passes through a small diameter hole, and fastens into the stainless steel hex nut cap. The bolt is tightened holding the hex nut firmly into place. Seated between the bolt and the interior of the waterproof housing is a lock washer 70 and a round electrical connector 75. Electrical wire 80 connects the water conductivity contacts to the CPU. There are two water conductivity contacts, one on each side of the invention.

Figure 5:
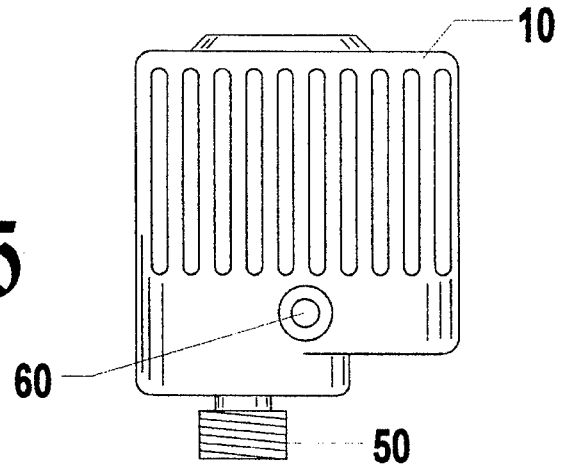
FIG. 5 is a perspective assembled side view of the low air warning device for scuba divers of the present invention.

With reference now to FIG. 5, a view of a fully assembled unit showing the waterproof housing 10, the threaded portion of the pressure switch 50 protruding through the bottom. One of two water conductivity contacts, shown is the stainless steel hex nut cap 60. Total height of the invention is approximately 2.54 inches. The width is approximately 1.94 inches. The depth is approximately 1.59 inches. The new low air warning device will be waterproof to 250 feet.

OPERATION OF INVENTION

The new low air warning device for scuba divers is screwed into the first stage of the air regulator. The first stage of the air regulator is that portion which is attached to the top of the divers air tank. The low air warning device is screwed into a high pressure port. If a spare high pressure port is not available, a "Y" fitting can be used to fasten the low air warning device to any high pressure port. The first stage of the air regulator is equipped with both high and low pressure air ports. The low pressure air port is used to supply low pressure air to the diver's mouth piece for breathing. The high pressure air port(s) is actual tank pressure and is used for a diver's air gauge. The low air warning device automatically activates itself when immersed into water. The low air warning device utilizes two stainless steel contacts located on the outside of the waterproof housing to enable the low air warning device's drive circuit. Before the dive and before the low air warning device is immersed into water, device testing is possible. A air valve is located at the top of the air tank. The air valve supplies air to the first stage of the air regulator. Before the air valve is turned on, connect the two stainless steel contacts with two finger tips. The natural conductivity of the finger tips enables the low air warning device's circuit. Because the air supply has not yet been turned on and no air is being introduced into the low air warning device, the low air warning device will activate and begin to alarm. With the alarm sounding, slowly turn on the air supply. As the air pressure rises, the alarm will cease when a pressure of 350 psi or more is reached. At 350 psi and above, sufficient air pressure is being forced into the air pressure switch to disconnect the drive circuit of the low air warning device. When the dive is initiated and the low air warning device is submerged into water, the low air warning device is turned on. The water surrounding the two stainless steel contacts enables the CPU. From the beginning of the dive, the low air warning device begins to monitor the diver's air supply. When the air pressure drops to 350 psi or less, the low air warning device will sound its audible alarm. The air pressure introduced into the unit is insufficient to hold the pressure switch contacts open and subsequent sounding of the audible alarm is achieved. Once the low air warning device is taken out of the water, the alarm will cease.

Conclusions, Ramifications, and Scope of Invention

This new and improved low air warning device for scuba divers will fulfill the need for a dependable and easy way to monitor the diver's air supply. Being completely automatic and carefree, the ease of use, the compact size, and inexpensive to construct, this low air warning device will become very popular as the ultimate in diver safety. Hopefully, divers will never hear this low warning device activate while diving. Through careful monitoring of the diver's air gauge, divers should know their limitations and ascend at the recommended air level. Diver certification organizations recommend ascending at 500 psi. But in the event a diver becomes complacent, the air gauge is inaccurate, the diver misreads the air gauge, or the air gauge is faulty, the low air warning device will give off an audible alarm. On occasion, a scuba diver may forget to turn back on his or her air tank valve after the equipment critical inspection. In this case, the low air warning device will immediately begin to sound upon jumping into the water. Now the air supply can easily be turned back on, while at the surface not after the descent is begun.

Although the description above contains many specificities, these should not be construed as limitations or limiting the scope of the invention but merely providing illustrations of some of the presently preferred embodiments of this invention. For example, the water conductivity on-off switch could be replaced with a pressure activated switch. Instead of the conductivity of water to enable the low air warning device, ambient water pressure could be used to activate the low air warning device. The device could automatically turn on and off once a specific depth is reached. The major point with the on-off switch is that it is of an automatic type.

Thus the scope of the invention should be determined by the appended claims and their legal equivalents, rather than by the examples given.

What is being claimed is new and desired to be protected by the U.S. Patent and Trademark Office as follows:

1. A low air warning device for alerting a scuba diver when the pressure of air in an air tank being used by the scuba diver falls below a predetermined level; said device producing an audible signal within the range of hearing of the diver when the pressure of air within the air tank falls below the predetermined level; said device comprising:

a) an electrical energy source providing electrical power for the operation of said device;

b. a piezoelectric speaker element operable for producing said audible signal wherein said audible signal has a frequency within the range of human hearing;

c) a central processing unit (CPU) providing: (i) input means for receiving an electrical signal from an air tank pressure sensor, (ii) means for comparing said electrical signal with a reference signal, said reference signal being equal to the electrical signal produced by said air tank pressure sensor when the pressure of air within an air tank is at said predetermined level, and (iii) output means operable for controlling the production of said audible signal by said piezoelectric speaker element;

d) a water conductivity switch comprising two stainless steel contacts in electrical communication with said CPU operable for causing electrical power to be supplied to said CPU when said device is immersed in water;

e) said air tank pressure sensor in electrical communication with said CPU, said air tank pressure sensor being operable for presenting an electrical signal to said input means of said CPU; and f) a waterproof outer casing; and wherein said electrical energy source, said CPU, said water conductivity switch, said air tank pressure sensor and said piezoelectric speaker element are all housed within said waterproof outer casing and wherein said piezoelectric speaker element produces said audible signal only when said electrical signal is less than or equal to said reference signal.

* * * * *